United States Patent [19]

Düsch

[11] Patent Number: 4,589,362

[45] Date of Patent: May 20, 1986

[54] THREAD CUTTING DEVICE IN LOCKSTITCH SEWING MACHINES

[75] Inventor: Albert Düsch, Kaiserslautern, Fed. Rep. of Germany

[73] Assignee: Pfaff Industriemaschinen GmbH, Fed. Rep. of Germany

[21] Appl. No.: 473,607

[22] Filed: Mar. 9, 1983

[30] Foreign Application Priority Data

Mar. 6, 1982 [DE] Fed. Rep. of Germany ..... 3208159

[51] Int. Cl.[4] ..... D05B 65/00

[52] U.S. Cl. ..... 112/292; 112/297; 112/300

[58] Field of Search ..... 112/291, 292, 293, 294, 112/295, 300, 297

[56] References Cited

U.S. PATENT DOCUMENTS 3,624,735 11/1971 Hedegaard ..... 112/292

4,455,957 6/1984 Vollmar ..... 112/292

FOREIGN PATENT DOCUMENTS 2325609 3/1974 Fed. Rep. of Germany ..... 112/292

*Primary Examiner*—Wm. Carter Reynolds

*Attorney, Agent, or Firm*—McGlew and Tuttle

[57] ABSTRACT

A thread cutting device for a lockstitch sewing machine having a rotary hook rotating in a horizontal plane, comprises a thread catcher which is pivotable in a horizontal plane and designed with a catch shoulder for needle and bobbin threads. The catcher cooperates with a stationary cutting tool as well as with a leaf spring which serves as a clamp for the end portion of the bobbin thread. The thread catcher is designed with a retaining shoulder by which the needle thread loop, upon being passed around the bobbin case, is caught and then released before being cut. The temporarily retained thread length substantially corresponds to the thread length which is pulled out sidewards while the thread catcher moves into its cutting position. Since no needle thread is thereby pulled off the thread supply by the thread catcher, only a minimum force is needed for moving the catcher.

17 Claims, 10 Drawing Figures

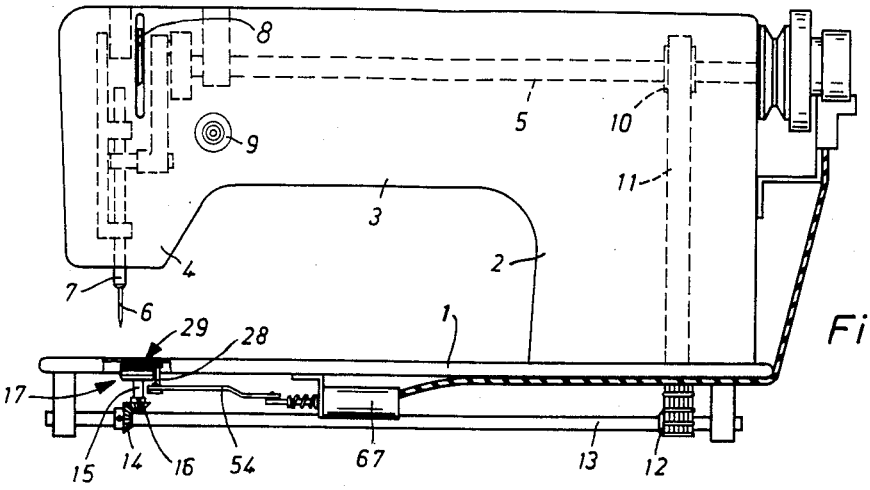
Fig. 1
Fig. 2
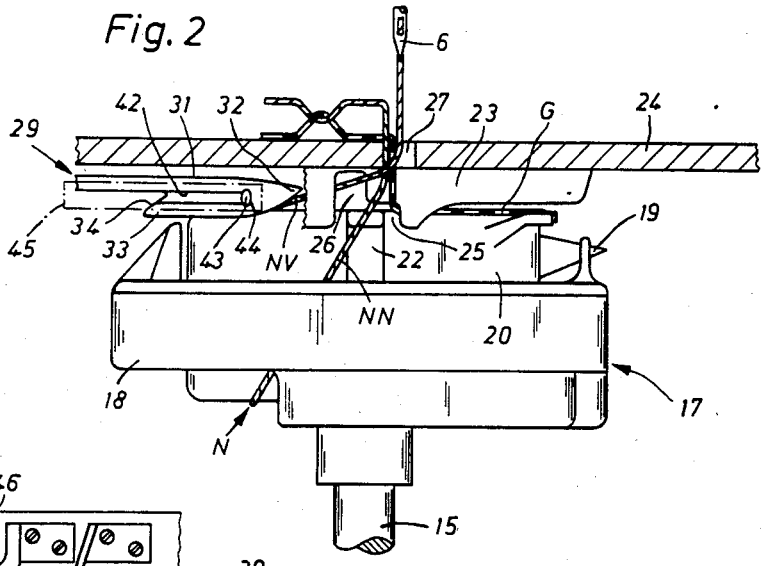
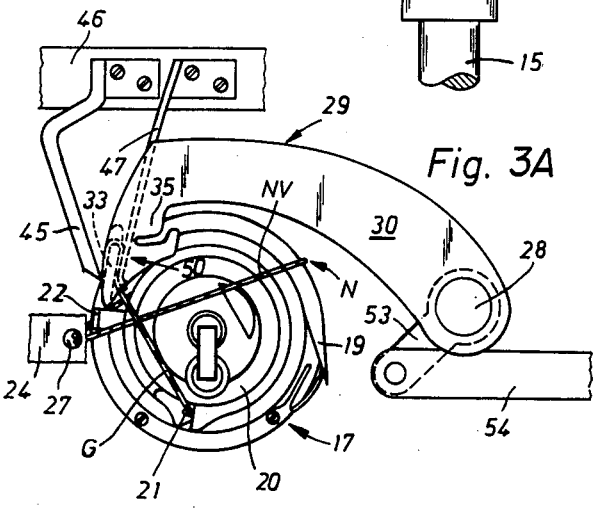
Fig. 3A
Fig. 3B
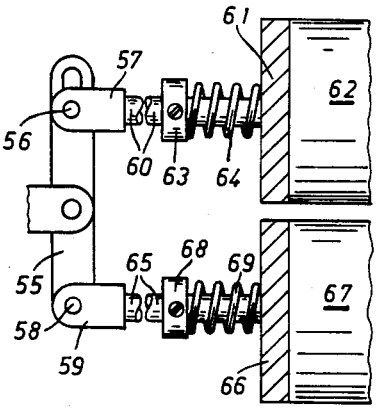

THREAD CUTTING DEVICE IN LOCKSTITCH SEWING MACHINES

FIELD AND BACKGROUND OF THE INVENTION

The present invention relates in general to sewing machines and in particular to a new and useful thread cutting device for lockstitch sewing machines having a rotary hook rotating in a horizontal plane with a bobbin case mounted in the rotary hook, a thread catcher and a cutting tool cooperating with the thread catcher to cut a needle and bobbin thread and, at the same time hold the bobbin thread.

A thread cutting device for a sewing machine in disclosed in German Pat. No. 23 25 609. That device comprises a thread catcher which is pivotable in a horizontal plane above a rotary hook and is designed with a separating finger formed on an arm, and a catch shoulder provided below the finger. At the underside of the separating finger, close to a pointed end thereof, a hook for catching the bobbin thread is mounted, permitting a long bobbin thread end portion extending to the thread supply.

To effect a cutting operation, the thread catcher is moved upon the instant at which the needle thread loop is passed around about one half the bobbin case, in a first pivotal step, from an initial position into a catch position, with the separating finger penetrating into the needle thread loop below the loop at the supply side, but above the bobbin thread, and the catch hook taking hold of the bobbin thread. After this first pivotal step, the thread catcher stops until the needle thread loop is passed around the entire bobbin case and pulled upwardly, by the take-up lever on the sewing machine, up to the thread catcher. Only after the needle thread loop is engaged on the separating finger and the legs of the needle thread loop come into a firm, controlled position, the thread catcher is moved farther in a second pivotal step, in the direction of the stationary cutting knife.

At the start of the second pivotal step, the catch shoulder applies against the needle thread loop, whereby, in the course of this second pivotal step, the needle thread is pulled off the thread supply, in addition to pulling off the bobbin thread. Since during this operation, the needle thread loop is firmly engaged on the separating finger so that still another deflection point is present in addition to the almost rectangular deflection at the stitch hole edge, and the other deflection points by which the pulling of the needle thread off the thread supply is anyway braked, namely the needle eye, the take-up lever, the thread tightener, and the various eyelets for the thread, a relatively strong force is required for performing the second pivotal step of the thread catcher, even with the tightener in an open position. With thick threads having unfavorable frictional properties, it may even be necessary to equip the thread cutting device with an auxiliary drive, agumenting the driving force.

SUMMARY OF THE INVENTION

The present invention is directed to a thread cutting device which requires only a very small force for effecting a cutting operation.

Upon starting a cutting operation, and with the thread catcher pivoted into its catching position, the needle thread loop, upon being passed around the bobbin case, is caught up and retained by the retaining shoulder, so that only a small portion of the needle thread loop, which has been enlarged while being passed around the bobbin case, can be pulled upwardly by the take-up lever through the stitch hole. Only after the catch shoulder, in the course of further pivotal motion of the thread catcher, bumps against the needle thread loop, does the loop slip off the retaining shoulder, so that the catch shoulder is capable of deflecting the freed portion of the needle thread loop without an appreciable resistance in the direction of the cutting tool.

By suitably dimensioning the retaining shoulder in relation to the path of motion of the thread catcher, namely by providing a height of the retaining shoulder substantially corresponding to the distance between the needle thread catching position and the cutting position of the catch shoulder, the length of the thread portion temporarily retained by the retaining shoulder is made substantially equal to the thread length which is pulled sidewardly out during the motion of the thread catcher into its cutting position. Since the thread length required for this purpose has earlier been retained below the needle plate, and is released only as wanted, the thread catcher need not pull off any needle thread from the thread supply. Consequently, no particular force is required for performing the cutting operation.

According to one feature of the invention, the retaining shoulder is formed by a step-like portion of the arm. The stepped shape of the retaining shoulder, with an edge portion extending substantially concentrically of the pivotal axis of the thread catcher, makes it possible to catch and firmly retain the needle thread loop safely even in instances where the needle thread is twisted and, upon being passed around the bobbin case, tends to perform uncontrollable movements.

According to another feature of the invention, the point of the separating finger is provided at the arm side remote from the cutting tool. Due to this design, the thread catcher can penetrate into the needle thread loop already during its first pivotal motion, from its cutting or rest position. There is no need for pivoting it first into an initial position wherefrom it would penetrate into the needle thread loop.

With rotary hooks rotating in a horizontal plane, the bobbin thread end must be firmly retained in a thread clamp retained during the first stitch, to ensure that it will be engaged by the needle thread loop and that, consequently, after cutting the thread, the needle thread and the bobbin thread become securely locked with each other at the start of a new sewing operation. Therefore, prior to cutting the thread, the thread portion close to the thread supply of the bobbin thread must be introduced into a thread clamp and it must be made sure that up to its engagement by a needle thread loop, this portion remains in the clamp. This requirement means that the needle thread must be prevented from being caught in the thread clamp along with the bobbin thread since in such a case, a risk would be run that by pulling the needle thread end out of the thread clamp, the bobbin thread end would be pulled out too and could no longer be engaged by the needle thread loop subsequently to be formed.

This risk may be avoided by forming the thread catcher to have the effect that, immediately before the cutting operation, the needle and bobbin thread portions leading to the respective thread supplies extend in mutually different directions or are spaced from each other, so that with a suitable arrangement or design of a thread clamp, only the bobbin thread is clamped, as desired.

According to another feature, the retaining shoulder of the thread catcher extends in the plane of the inner longitudinal side of the catch shoulder. With a thread catcher of such design, the leg at the thread supply side of the needle thread loop extends close to the inner longitudinal side of the catch shoulder before the cutting operation. The bobbin thread portion between the front edge of the catch shoulder and the thread supply, on the contrary, extends at an angle of about 35° relative to the leg adjacent the catch shoulder of the needle thread loop. This divergence in directions of the threads makes it possible to mount a stationary two-legged thread clamp having horizontally extending clamping surfaces and known per se, in such a way that the clamp legs do cross the bobbin thread portion leading to the thread supply, and yet the free ends of the clamp legs terminate at a location frontally spaced from the needle thread loop leg adjacent the catch shoulder. The thread catch thus pulls the bobbin thread into the thread clamp, while the needle thread remains outside the thread clamp.

According to still another feature of the invention, the underside of the retaining shoulder forms a part of a thread clamp. In this design, the adjustment of the clamping means is particularly simple, since the extension of the bobbin thread is determined by the thread catcher.

In another embodiment of the thread catcher, the retaining shoulder terminates at the rounded bottom of a slot which bottom is spaced from the catch shoulder. Because of this slot, during the period of time just before the cutting operation, the portion of the needle thread loop leg extending from the leading edge of the catch shoulder to the thread supply, extends below the thread catcher arm substantially transversely to the longitudinal sides of the catch shoulder. The bobbin thread portion running from the thread supply to the leading edge of the catch shoulder extends substantially at the same angle to the inner longitudinal side of the catch shoulder is indicated above in connection with the first embodiment of the thread catcher. This portion therefore extends between the catch shoulder and the needle thread loop portion extending below the thread catcher, transversely of the longitudinal sides thereof, so that in this embodiment again, the threads extend in mutually different directions.

According to a feature of the second embodiment of the thread catcher, the inner longitudinal side of the catch shoulder forms a part of a thread clamp. In this design, prior to the cut, the bobbin thread becomes clamped between the catch shoulder and a resilient part of the clamp. Since the needle thread loop portion passing below the arm extends substantially transversely to the vertically aligned clamping surfaces of the thread clamp, there is no risk that this portion would also be introduced into the threaded clamp.

To further ensure that the needle thread loop will properly be caught, a catch hook is formed on the arm at a location horizontally spaced from the retaining shoulder.

According to another feature of this embodiment of a thread catcher with a catch hook, the underside of the catch hook forms a part of the thread clamp. In this design, the needle thread loop leg leading to the thread supply extends on the leading edge of the catch shoulder below the thread catcher to the rounded bottom of the slot and therefrom above the catch hook to the stitch hole of the needle plate. With a thread clamp formed by the catch hook and a subjacent clamp spring, the pivotal motion of the thread catcher into its cutting position produces the effect that the needle thread loop portion extending below the thread catcher is pulled through the thread clamp. At the same time, it is ensured that at the instant of thread cutting, this portion will again extend outside the clamp. On the other hand, the bobbin thread portion running from the thread supply to the leading edge of the catch shoulder and extending below the catch hook is safely introduced into the thread clamp and firmly retained therein even after the thread cutting operation.

Accordingly an object of the present invention is to provide a thread cutting device for a lockstitch sewing machine having a rotary hook rotating at a horizontal plane in which a bobbin case is mounted, a thread catcher which is pivotable in a horizontal plane and cooperates with a cutting tool to cut a needle and bobbin thread, and including a separating finger formed on an arm and with a catch shoulder extending beneath the arm, comprising the thread catcher formed with a retaining shoulder by which a needle thread loop, after being passed around the bobbin case, is caught and released prior to being cut, with a height of the shoulder being determinative of the retained length of the needle thread, substantially corresponding to a distance between a needle thread catch positioned and a cutting position of the catch shoulder.

A further object of the present invention is to provide such a device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the following the invention is explained with reference to two embodiments shown in the drawings in which:

FIG. 1 is a side elevational view of a sewing machine used with the invention;

FIG. 2 is an enlarged side view of the rotary hook, the needle plate, and the thread catcher used with the invention;

FIG. 3A is a top plan view of the thread cutting device and the rotary hook, with the thread catcher in the cutting or rest position at the start of the first stitch formation in a new sewing operation;

FIG. 3B is a top plan view of a driving mechanism for the connecting bar of a thread catcher shown in FIG. 3A;

DESCRIPTION OF THE PREFERRED EMBODIMENTS

Figure 4:
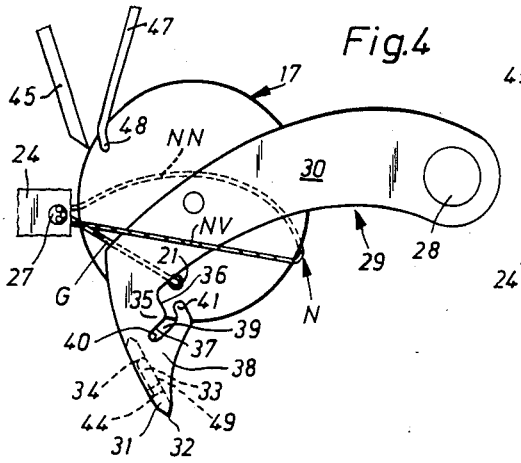
FIGS. 4 to 7 are top plan views and show consecutive phases of the thread catcher motion.

As shown in FIG. 1, the sewing machine comprises a bed plate 1, a standard 2, and an arm 3 with a head 4. An arm shaft 5 mounted within arm 3 is operatively connected to a needle bar 7 which is movable up and down in head 4 and carries a thread guiding needle 6. Also mounted in head 4 is a take-up lever 8 which cooperates, in a manner known per se, with needle 6 and is driven by arm shaft 5 to perform an up and down movement. Head 4 further accommodates a thread tightener 9 which can be switched into an open position by means of the mechanism known per se (not shown).

Secured to arm shaft 5 is a belt pulley 10 transmitting the rotation of arm shaft 5 through a belt 11 and another belt pulley 12, with a reduction of one or two, to a shaft 13 which is mounted within bed plate 1 and drives the rotary hook. Secured to hook driving shaft 13 is a bevel gear 14 meshing with a mating gear 16 which is mounted on the vertically extending shaft 15 of the rotary hook. The lockstitching hook 17 is carried on the upper end of shaft 15 and driven for rotation in a horizontal plane.

Lockstitch hook 17, as shown in FIG. 2, comprises a hook body 18 and a hook point 19 formed thereon. A bobbin case 20 is mounted in the hook body 18. In a known manner, bobbin case 20 accommodates a bobbin (not shown) carrying the bobbin thread G which is run out of case 20 through an outlet 21 provided on the top thereof. On its side close to needle 6, case 20 is provided with a stop finger 22 extending laterally and upwardly.

Stop finger 22 projects into a cutout 25 which is provided in an extension 23 of needle plate 24 (FIG. 2) and thus prevents bobbin case 20 from following the rotary motion. In the upward direction, cutout 25 is deepened by another cutout 26 of about half the width, which reaches up close to the underside of needle plate 24. The two cutouts 25,26 form together a stepped recess in extension 23. Needle plate 24 is provided with a stitch hole 27 forming a passage for needle 6.

Laterally of hook shaft 15, a thread catcher 29 is secured to an also vertically extending shaft 28. Thread catcher 29 comprises an arm 30 which is movable in a horizontal plane in the space between the underside of needle plate 24 and the top of bobbin case 20. On its free end, arm 30 is formed with a separating finger 31 terminating in a point 32 (FIG. 4). Beneath separating finger 31, a catch shoulder 33 is provided which extends in a vertical plane and whose leading edge 34 forms together with separating finger 31 a V-shaped indentation. The path of motion of catch shoulder 33 extends between the central outer surface of bobbin case 20 and the upper end of stop finger 22. The path of motion of point 32 of separating finger 31 extends above the upper horizontal boundary of cutout 25.

Figure 5:
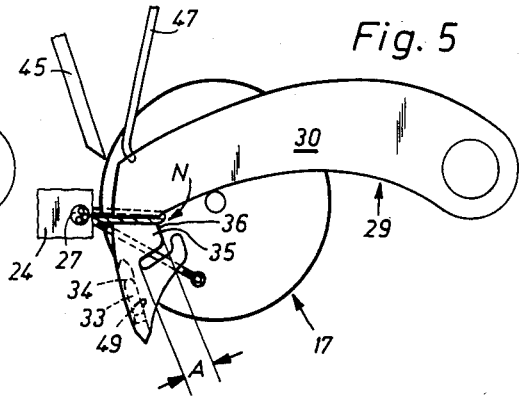
Figure 6:
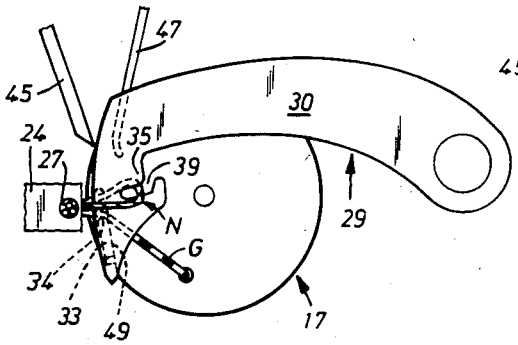

Arm 30 of thread catcher 29 is further formed with a step-like retaining shoulder 35 which extends in a horizontal plane. One edge 36 of shoulder 35 extends substantially perpendicularly to arm 30 (FIG. 4), while the other edge 37 extends substantially parallel to arm 30. Another portion formed on arm 30 is a catch hook 38 which again extends in a horizontal plane and is uniformly spaced from retaining shoulder 35. A slot 39 is thereby formed therebetween, terminating in a rounded bottom 40 at a location laterally spaced from leading edge 34 of catch shoulder 33. Catch hook 38 is formed with a tip 41 extending parallel to edge 36, and merges, at its opposite side, into point 32 of separating finger 31. The length of edge 37 is understood to be the height A of retaining shoulder 35 as shown in FIG. 5.

On the outer longitudinal side opposite stitch hole 27 of thread catcher 29, a groove 42 is provided (FIG. 2) extending from leading edge 34 substantially parallel to the path of motion of thread catcher 29, and terminating in a cross bore 43. The terminal edge 44 of groove 42 forms a counterblade for a cutting knife 45 cooperating with thread catcher 29 and carried on a support 46 which is secured to the underside of base plate 1. The shape of thread catcher 29 is such that only the portion extending in the zone of terminal edge 44 of its side face opposing stitch hole 27 can come into contact with cutting knife 45.

Further secured to support 46 is a leaf spring 47 which extends laterally of cutting knife 45 in a vertical plane and has an angled portion 48 on its free end. With thread catcher 29 in the cutting or rest position (FIGS. 3A, 3B and 7), leaf spring 47, along with the inner longitudinal side 49 (FIG. 4) of catch shoulder 33, forms a thread clamp 50 for bobbin thread G.

Figure 8:
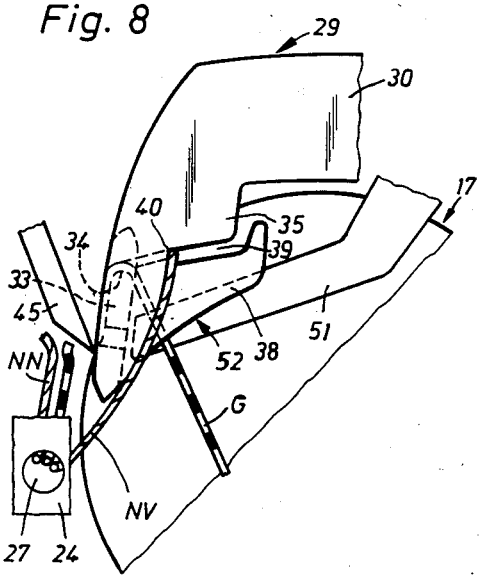
FIG. 8 is an enlarged view of the thread catcher in the cutting position, showing another embodiment of the thread clamp.

FIG. 8 shows another embodiment of a thread clamp. In this design, a substantially horizontally extending leaf spring 51 is provided which, along with the underside of catch hook 38 and with thread catcher 29 in the cutting or rest position, forms the thread clamp 52 for bobbin thread G.

To the lower end of shaft 28 of thread catcher 29, a crank 53 (FIGS. 3A and 3B) is secured having its free end hinged to a connecting bar 54. On the other end of connecting bar 54 a double lever 55 is provided whose one end is hinged by a pin 56 to a forked head 57, while its other end is hinged by a pin 58 to a forked head 59. Forked head 57 is connected to a connecting rod 60 of an electromagnet 62 which is secured through a support 61 to bed plate 1. Between support 61 and a set ring 63, a compression spring 64 is provided on connecting rod 60. Forked head 59 is connected to a connecting rod 65 of an electromagnet 67 which also is secured by means of a support 66 to base plate 1. Between support 66 and set ring 68, a compression spring 69 is provided on connecting rod 65.

Figure 9:
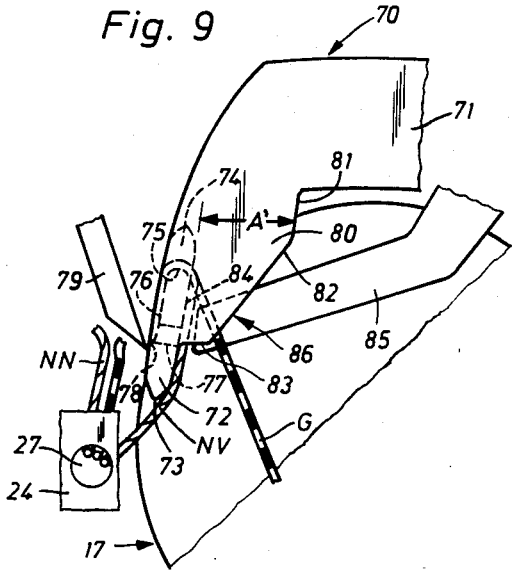
FIG. 9 is an enlarged view showing another embodiment of the thread catcher in the cutting position.

Of the second embodiment of a thread catcher 70 shown in FIG. 9, only a portion of arm 71 is shown. On the free end of arm 71, a separating finger 72 is formed terminating in a point 73. Beneath separating finger 72, a catch shoulder 74 is provided extending in a vertical plane and having a front edge 75. On the outer longitudinal side of catch shoulder 74, a groove 76 is provided terminating in a cross bore 77. The terminal end 78 of groove 76 forms a counterblade for a cutting knife 79 cooperating with thread catcher 70.

Arm 71 is formed with a step-like retaining shoulder 80 which extends in a horizontal plane. One edge 81 of shoulder 80 extends substantially perpendicularly to arm 71 and has a length identical with that of edge 36 in the first embodiment, i.e. of thread catcher 29. The position of edge 81 relative to leading edge 75 of catch shoulder 74 also corresponds to the position of edge 36 relative to leading edge 34 of catch shoulder 33. Edge 81 extending substantially transversely to arm 71 is followed by an obliquely extending edge 82 which in turn is followed by an edge 83 extending substantially parallel to arm 71. Edge 83 terminates directly at the inner longitudinal side 84 of catch shoulder 74. The spacing between edge 81 and the inner longitudinal side 84 of catch shoulder 74 is understood to be the amount A' which is the height of retaining shoulder 80.

A leaf spring 85 extending substantially horizontally is provided in spaced relationship with a cutting knife 79. With thread catcher 70 in the cutting or rest position, spring 85 along with the underside of retaining shoulder 80, forms a thread clamp 86 for bobbin thread G. The free end of leaf spring 85 is spaced from the inner longitudinal side 84 of catch shoulder 74 by a distance which exceeds the maximum possible thickness of the needle thread.

The thread cutting device operates as follows:

At the end of a sewing operation, the sewing machine is stopped, by means of a positioning motor known per se, with the needle 6 in the lowermost position. This is followed by half a revolution of arm shaft 5, to pull needle 6 out of the workpiece.

After the point of needle 6 comes into a position about 10 mm above needle plate 24, the circuits of both electromagnets 62 and 67 are simultaneously closed. Electromagnets 62, 67 are thereby energized and move thread catcher 29, through double lever 55, connecting bar 54, and crank 53, from its cutting or or rest position shown in FIGS. 3A and 3B into its catching position shown in FIG. 4.

During this pivotal motion of thread catcher 29, the sewing threads come about into positions shown in FIG. 2. Bobbin thread G extends from outlet 21 at a very flat angle to cutout 25 and therefrom upwardly to stitch hole 27. At this time, the needle thread still forms a needle thread loop N embracing bobbin case 20 and having a leg NV leading to the thread supply and a leg NN leading to the work. Since the loop leg NV leading to the thread supply extends through cutout 26 which reaches close up to the underside of needle plate 24, this loop portion extends relative to needle plate 24 at a much steeper angle than bobbin thread G. Consequently, within the two cutouts 25,26, bobbin thread G and loop leg NV leading to the thread supply become vertically spaced.

During the pivotal motion of thread catcher 29 into its catching position, point 32 of separating finger 31 moves beyond bobbin thread G and, below loop leg NV leading to the thread supply, into the enlarged needle thread loop N. Thread catcher 29 remains in its catching position until needle thread loop N is passed around bobbin case 20 and pulled up to thread catcher 29 by take-up lever 8. This causes needle thread loop N to be engaged by retaining shoulder 35. As soon as needle thread loop N is pulled tight on retaining shoulder 35, electromagnet 62 is de-energized, so that double lever 55 is pivoted by compression spring 64 about pin 58. As a result, thread catcher 29 is pivoted through connecting bar 54 and crank 53 from its catching position into its position shown in FIG. 5. This means that thread catcher 29 moves in the same direction in which take-up lever 8 pulls needle thread loop N farther out of the zone below needle plate 24. In this way, the pivotal motion of thread catcher 29 does not encounter any resistance. Since needle thread loop N might have loosened during the pivotal motion, take-up lever 8 pulls the loop tight once more in the position shown in FIG. 5, about retaining shoulder 35, to get the legs NV and NM of the loop always into a fixed controlled initial position for the following cutting operation. Simultaneously, thread tightener 9 opens, so that take-up lever 8 is able to pull the needle thread from the supply during its next upward motion.

Immediately after de-energizing electromagnet 62, the circuit of electromagnet 67 is also interrupted, whereupon double lever 55 is pivoted by compression spring 69 about pin 56 which now is the axis of rotation. Thereby, immediately upon reaching its position shown in FIG. 5, thread catcher 29 is further pivoted in the direction of cutting knife 45, during which motion leading edge 34 of catch shoulder 33 engages bobbin thread G and pulls it along on this way. At the same time, needle thread loop N slides along edge 36 of leading shoulder 35 and drops from this shoulder 35 into slot 39 about at the instant at which leading edge 34 of catch shoulder 33 engages needle thread loop N. Consequently, during its further pivotal motion too, thread catcher 29 is capable of penetrating against no appreciable resistance into the needle thread loop N becoming free, and of deflecting it in the direction of cutting knife 45.

Toward the end of the pivotal motion of thread catcher 29, the portion of bobbin thread G extending from leading edge 34 of catch shoulder 33 to outlet 21 is introduced into thread clamp 50, i.e. clamped between inner longitudinal side 49 of catch shoulder 33 and leaf spring 47. Simultaneously, the portion extending from leading edge 34 to the work, of bobbin thread G, and loop leg NN, engage groove 42, while needle thread loop N gets pulled tight at the bottom 40 of slot 39. Since the loop portion running from leading edge 34 to bottom 40 extends transversely to the clamping surfaces of thread clamp 50, there is no risk of clamping this portion inadvertently.

At the end of the pivotal motion of thread catcher 29, upon take-up lever 8 has reached its upper dead center position, the portions engaged in groove 42 of the needle and bobbin threads are cut by cutting knife 45 at the terminal edge 44.

Since the height A of retaining shoulder 35 substantially corresponds to the distance between the needle thread catch position and the cutting position of catch shoulder 33, retaining shoulder 35 temporarily retains a thread portion of such length which subsequently is needed during the motion of thread catcher 29 toward cutting knife 45 for pulling or deflecting needle thread loop N in the sideward direction. Thus, since no needle thread is pulled off the thread supply by thread catcher 29 during the entire pivotal motion thereof, no particular force is need at any instant for effecting this motion.

Figure 7:
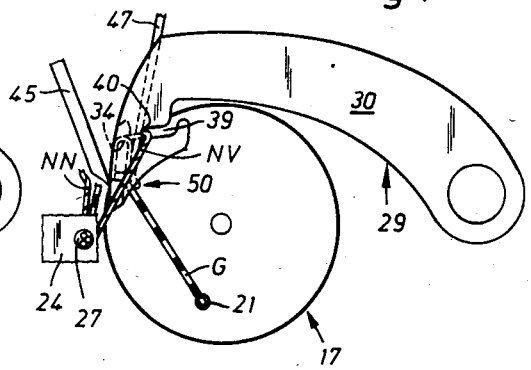

During the start of the subsequent sewing operation, thread catcher 29 remains in its cutting or rest position shown in FIGS. 3A, 3B and 7, so that the bobbin thread portion leading to the thread supply remains clamped until, in the course of the first stitch formation of the sewing operation, this portion is pulled out from thread clamp 50.

Referring now to FIG. 8, with the thread clamp 52 formed by catch hook 38 and leaf spring 51, the leg portion NV of needle thread loop N running from leading edge 34 of catch shoulder 33 to slot bottom 40 and extending below thread catcher 29, is pulled past the free end of leaf spring 51 and thus pulled through thread clamp 52, as thread catcher 29 is moved into its cutting position. Still prior to reaching the cutting position, the needle thread leaves the zone of leaf spring 51, so that at the instant of cutting, the needle thread extends outside thread clamp. The portion running from the thread supply to leading edge 34 of the bobbin thread G, on the contrary, is safely introduced into thread clamp 52 and firmly retained therein also after the cutting operation.

With the thread catcher 70 shown in FIG. 9, the operation is similar to that with thread catcher 29. In the catch position of thread catcher 70, retaining shoulder 80 engages needle thread loop N which is passed around bobbin case 20, and retains it until loop N is engaged by leading edge 75 of catch shoulder 74. Then, needle thread loop N slides along oblique edge 82. The angle between edge 82 and catch shoulder 74 is chosen to the effect of always releasing only a needle thread length which at the same time is laterally pulled off or deflected by the pivotal motion of thread catcher 70.

Toward the end of the pivotal motion of thread catcher 70, needle thread loop N drops entirely from retaining shoulder 80, whereupon loop leg NV running from the thread supply to leading edge 75 snugly applies against inner longitudinal side 84 of catch shoulder 74. The retaining shoulder 80 terminates in a plane of the inner longitudinal side 85 of the catch shoulder 74. Then, the portion extending from leading edge 75 to the thread supply of bobbin thread G is introduced into thread clamp 86, i.e. clamped between the underside of retaining shoulder 80 and leaf spring 85. Since the free end of leaf spring 85 is spaced from inner longitudinal side 84 of catch shoulder 74 by a distance which exceeds the maximum possible thickness of the needle thread, no risk is run of inadvertently clamping at the same time the portion of needle thread loop N applying against the inner longitudinal side 84. At the end of the pivotal motion of thread catcher 70, the portions engaged in groove 76 of the needle and bobbin threads are cut by cutting knife 79 at terminal edge 78.

In the same way as with thread catcher 29, thread catcher 70 remains in its cutting or rest position during the start of the subsequent sewing operation, so that the portion extending from the thread supply of bobbin thread G remains clamped until during the formation of the first stitch of the following sewing operation, this portion is pulled out fo thread clamp 86 by the needle thread loop.

While specific embodiments of the invention have been shown and described in detail to illustrate the application of the principles of the invention, it will be understood that the invention may be embodied otherwise without departing from such principles.

What is claimed is:

1. A thread cutting device for a sewing machine having a rotary hook and a bobbin case mounted in the rotary hook with a bobbin thread supplyable from the bobbin case and a needle thread movable by a sewing machine needle, comprising:

a thread catcher having a rotatably mounted arm;

drive means connected to said thread catcher arm for rotating said arm over at least a portion of the bobbin case; and a cutting tool associated with said thread catcher arm for cutting needle and bobbin thread;

said thread catcher arm including a catch shoulder extending toward the bobbin case for catching the bobbin thread, a retaining shoulder for retaining a loop of needle thread after the needle thread is passed around the bobbin case, said retaining shoulder having a dimension which determines the length of a portion of needle thread retained by said retaining shoulder which is substantially the same as a distance between a needle thread catch position and a cutting position for said catch shoulder of said thread catcher arm.

2. A device according to claim 1, wherein said retaining shoulder has one edge extending substantially perpendicularly to a major extent of said thread catcher arm and another edge extending substantially parallel to a major extent of said catcher arm.

3. A device according to claim 2, wherein said thread catcher arm has a separating finger at an end thereof terminating in a point for separating the needle thread from the bobbin thread, said point provided on a side of said catcher arm remote from said cutting tool.

4. A device according to claim 1, wherein said retaining shoulder terminates in a plane of said catch shoulder.

5. A device according to claim 1, including means forming a thread clamp for clamping the bobbin thread after it is cut.

6. A device according to claim 5, wherein said clamping means comprises a leaf spring positioned adjacent said cutting tool and cooperating with a side of said catch shoulder to retain a bobbin thread therebetween with movement of said catcher arm into its cutting position.

7. A device according to claim 5, wherein said clamping means comprises a leaf spring engageable on a lower surface of said catcher arm with movement of said catcher arm into its cutting position.

8. A device according to claim 1, wherein said thread catcher arm includes a catch hook forming a slot with one edge of said retaining shoulder for catching a loop of needle thread after it has moved off said retaining shoulder with movement of said arm from its catch position to its cutting position.

9. A thread cutting device for a lockstitch sewing machine having a rotary hook (17) rotating in a horizontal plane, a bobbin case (20) mounted in the rotary hook and a thread catcher (29,70) which is pivotable in a horizontal plane and cooperates with a cutting tool (45,79) and includes a separating finger (31,72) formed on an arm (30,71) and with a catch shoulder (33,74) extending therebeneath comprising: the thread catcher formed with a retaining shoulder (35,80) by which a needle thread loop, after being passed around the bobbin case, is caught and then released prior to being cut, with a height (A,A') of the shoulder (35.80) being deteriminative of the retained length of the needle thread, substantially corresponding to a distance between a needle thread catch position and the cutting position of the catch shoulder (33,74).

10. A thread cutting device according to claim 9, wherein the retaining shoulder (35,80) is formed by a step-shaped portion of the arm (30,71).

11. A thread cutting device according to claim 9, wherein a point (32,73) of the separating finger (31,72) is provided at a side remote from the cutting tool (45,79 of the arm (30,71).

12. A thread cutting device according to claim 9, wherein the retaining shoulder (80) terminates in a plane of an inner longitudinal side (84) of the catch shoulder (74).

13. A thread cutting device according to claim 12, wherein an underside of the retaining shoulder (80) forms a part of a thread clamp (86).

14. A thread cutting device according to claim 9, wherein the retaining shoulder (35) terminates in a rounded bottom (40) of a slot, at a location spaced from the catch shoulder (33).

15. A thread cutting device according to claim 14, wherein an inner longitudinal side (49) of the catch shoulder (33) forms a part of a thread clamp (50).

16. A thread cutting device according to claim 14, wherein a catch hook (38) is formed on the arm (30), which is horizontally spaced from the retaining shoulder (35).

17. A thread cutting device according to claim 16, wherein an underside of the catch hook (38) forms a part of a thread clamp (52).

* * * * *